US006073708A

United States Patent [19]

Brown et al.

[11] Patent Number: 6,073,708

[45] Date of Patent: Jun. 13, 2000

[54] DOWNHOLE MUD PRESSURE INTENSIFIER

[75] Inventors: John F. Brown; Gary W. Vandergrift, both of Calgary, Canada

[73] Assignee: Dynamo Drilling Services Inc., Calgary, Canada

[21] Appl. No.: 09/124,316

[22] Filed: Jul. 29, 1998

[51] Int. Cl.[7] ..... E21B 4/00

[52] U.S. Cl. ..... 175/93; 175/106

[58] Field of Search ..... 175/65, 93, 100, 175/106, 296

[56] References Cited

U.S. PATENT DOCUMENTS 4,047,581 9/1977 Erickson .
5,246,080 9/1993 Horvei et al. .
5,361,857 11/1994 Horvei et al. .
5,375,671 12/1994 Horvei .
5,662,180 9/1997 Coffman et al. ..... 175/57
5,787,998 8/1998 O'Hanlon et al. ..... 175/67
5,941,325 8/1999 Baekken et al. ..... 175/107

*Primary Examiner*—Thomas B. Will
*Assistant Examiner*—Meredith C Petravick
*Attorney, Agent, or Firm*—Felsman, Bradley, Vaden, Gunter & Dillon, LLP

[57] ABSTRACT

A mud pressure intensifier works with existing conventional drill strings without requiring special equipment or drilling fluids. The intensifier is self-contained and is located in the drill string between the drill bit and the rest of the string. The rotational power generated by a conventional mud motor is converted into reciprocal action to reciprocate a piston. The piston elevates the pressure of a portion of the mud on both the upstroke and the downstroke before discharging the pressurized mud at the drill bit.

24 Claims, 6 Drawing Sheets

DOWNHOLE MUD PRESSURE INTENSIFIER

TECHNICAL FIELD

This invention relates in general to downhole drilling tools and in particular to a mud pressure intensifier for a downhole drilling tool.

BACKGROUND ART

The penetration rate of a downhole drilling tool may be increased by increasing or "intensifying" the circulation pressure of the drilling mud as it exits the drill bit. Although prior art intensifiers were found to increase penetration rates and tool effectiveness, the design of intensifiers is limited by practical considerations such as mud pump restrictions and drill pipe degradation. Mud surface pressures in excess of 6000 psi prohibitively increase the cost of wear on surface equipment beyond the cost savings generated by the enhanced penetration.

One type of prior art intensifier elevates the pressure of a small percentage of the circulating mud by using the inner string of a dual drill pipe as a high pressure conduit to the bit. As with other prior art designs, the cost savings generated by the penetration rate increase did not justify the total cost burden placed on the drilling operation. A more efficient mud pressure intensifier design is needed.

DISCLOSURE OF THE INVENTION

A downhole mud pressure intensifier tool connects to the lower end of a conventional drill string and a drill bit is attached to lower end of the tool. The tool has an outer housing with a number of body segments which are rigidly secured and sealed to one another. The tool has an internal shaft with an upper end which is coupled to a conventional mud motor for rotation therewith. The shaft has a central passage for circulating drilling mud downward to the rest of the tool. The shaft has a plurality of evenly spaced apart, parallel cams. A tubular carrier cage surrounds the shaft. The carrier cage is free to move axially but restricted from rotation. The carrier cage is interlocked to the shaft with a plurality of cylindrical drive pins. A piston mandrel is fastened to the lower end of the carrier cage for axial movement therewith. The piston mandrel has a piston which engages a chamber in a piston housing. A hollow inner mandrel is coupled and sealed to a lower end of the shaft for rotation therewith and communicating drilling mud downward through the center of the piston mandrel. The piston housing has passages which communicate with the chamber.

The mud motor rotates the shaft while pumping fluid down through the center of the tool. The cams on the shaft cause the carrier cage to oscillate in a short axial path, which in turn cause the piston to reciprocate in the chamber. The piston simultaneously draws in and expels a small portion of the fluid from the inner mandrel. The fluid is communicated through the passages in the piston housing on both the upstroke and downstroke of the piston. The fluid is discharged from the chamber at high pressure and channeled to a dedicated nozzle in the bit via a flexible conduit. On the discharge side of the bit nozzle, the intensified fluid is reintroduced into the main fluid stream, thereby increasing the penetration rate of the drill bit.

BEST MODE FOR CARRYING OUT THE INVENTION

Figure 1A:
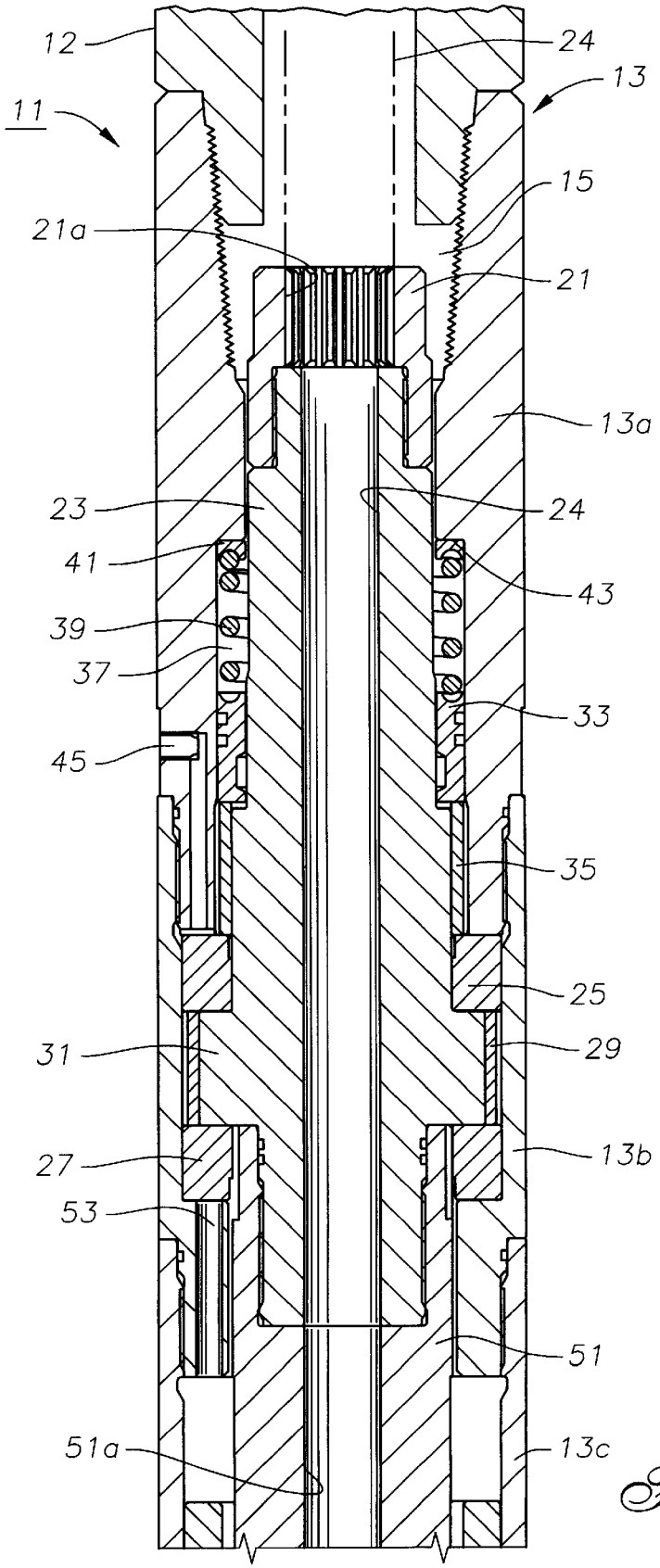
FIG. 1A is a sectional side view of the upper end of an intensifier constructed in accordance with the invention.
Figure 1B:
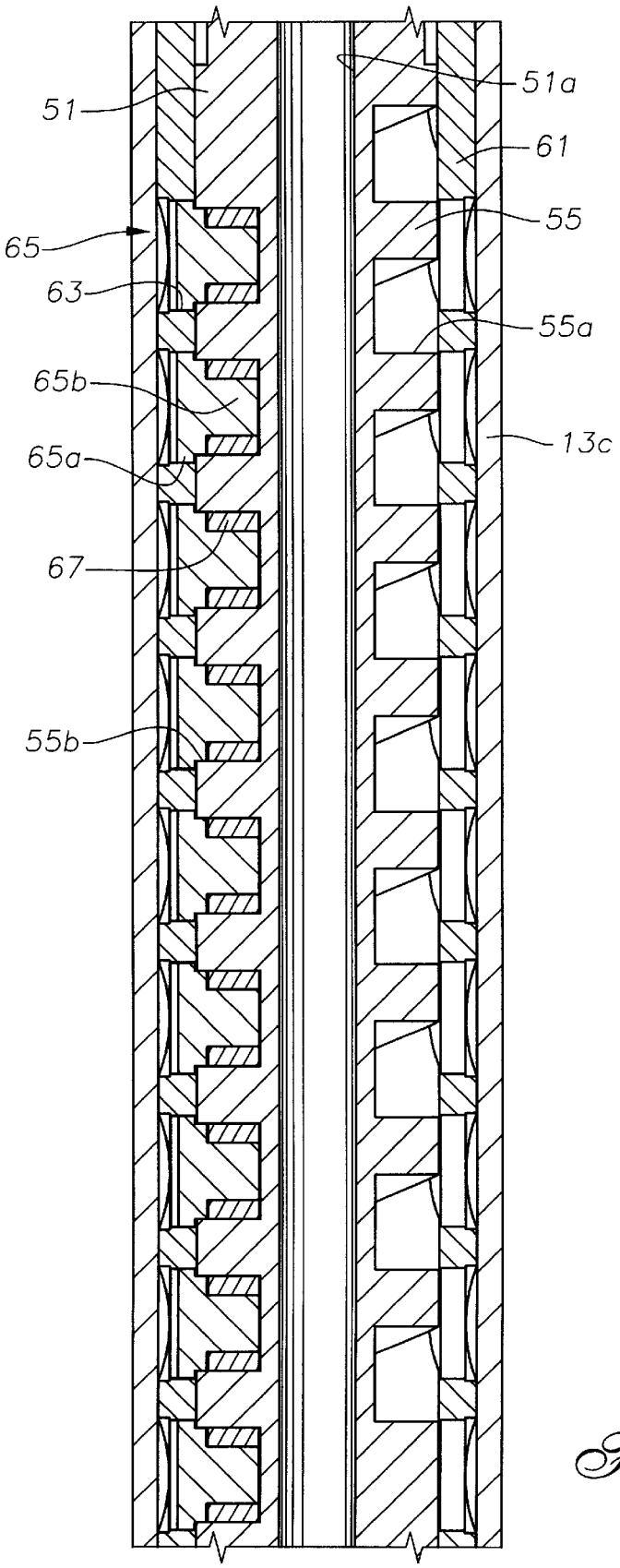
FIG. 1B is a sectional side view of the upper intermediate portion of the intensifier of FIG. 1A.
Figure 1C:
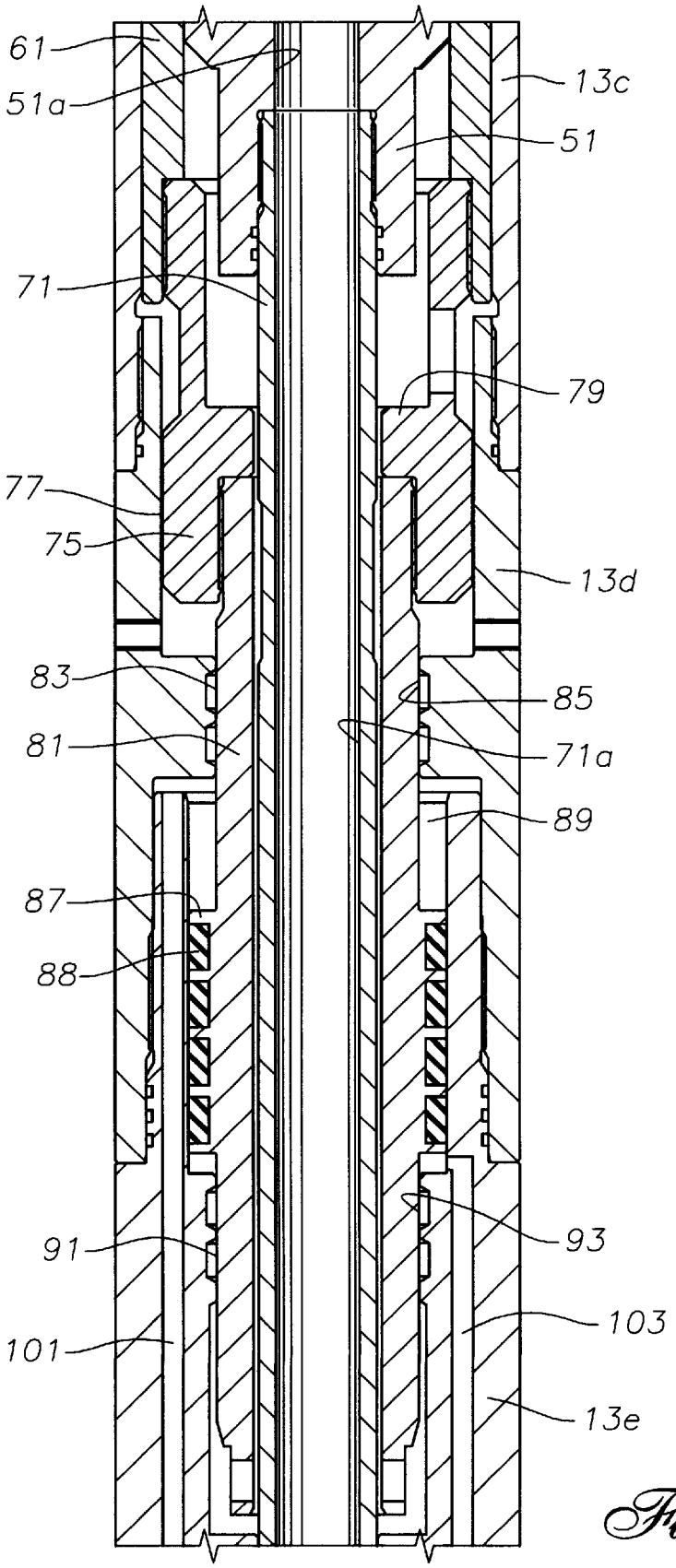
FIG. 1C is a sectional side view of the lower intermediate portion of the intensifier of FIG. 1A.
Figure 1D:
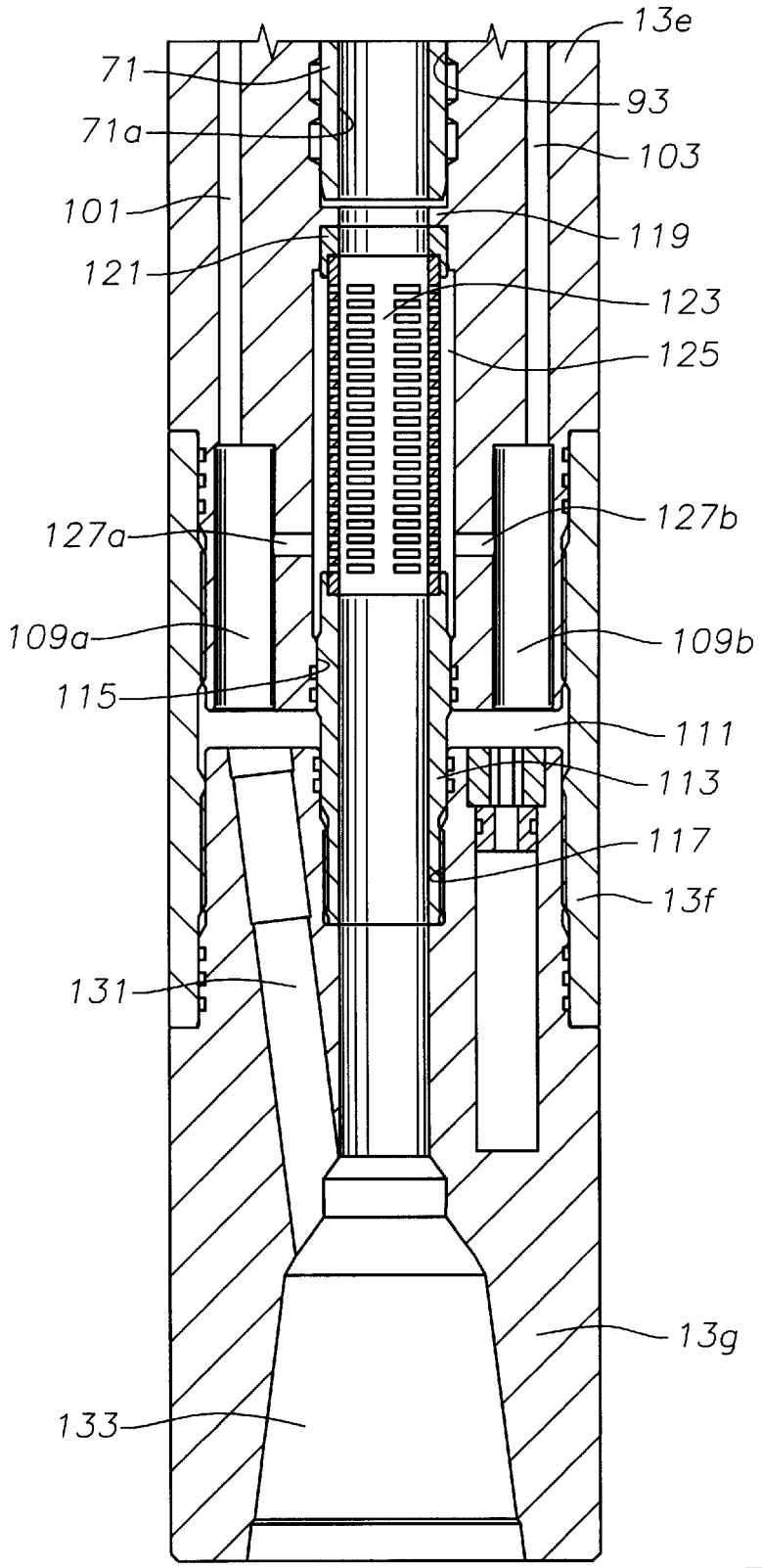
FIG. 1D is a sectional side view of the lower end of the intensifier of FIG. 1A.

Referring to FIGS. 1A–1D, a downhole mud pressure intensifier tool 11 for increasing the pressure of a portion of the drilling mud circulating within a drill string is shown. Tool 11 is adapted to connect to a conventional drill string 12 at its upper end (FIG. 1A), and to a drill bit (not shown) at its lower end (FIG. 1D). Tool 11 has a generally cylindrical, hollow body or housing 13 comprising a number of body segments which are rigidly secured and sealed to one another.

As shown in FIG. 1A, the upper end of tool 11 comprises a spline collar 21 which is rigidly coupled and sealed to a bearing shaft 23 for rotation therewith. Spline collar 21 and bearing shaft 23 extend through the first two segments of housing 13, top sub 13*a* and bearing housing 13*b*. Spline collar 21 is located within a cavity 15 in top sub 13*a* and has a central opening with internal splines 21*a* for engaging the drive shaft 24 of a conventional mud motor located within the rest of drill string 12. Bearing shaft 23 has a central passage 24 for circulating drilling mud downward to the rest of tool 11. Bearing shaft 23 will rotate relative to housing 13.

A pair of thrust bearings 25, 27 are preloaded in axially opposite directions between internal shoulders in top sub 13*a* and bearing housing 13*b* by a lower bushing 29. Thrust bearings 25, 27 sandwich an external flange 31 on a lower portion of bearing shaft 23 for absorbing axial thrusts experienced by bearing shaft 23. A coaxial oil piston 33 is located axially above an upper bushing 35 which abuts thrust bearing 25. Oil piston 33 is located radially between top sub 13*a* and bearing shaft 23 in an annulus 37. The upper end of a compression spring 39 seats in a spring support 41 which abuts a downward-facing shoulder 43 in top sub 13*a*.

Oil piston 33 is the top seal for the oil reservoir of the entire tool. Oil piston 33 is designed to move in response to pressure fluctuations in the oil, such as those caused by heating the oil and the resultant expansion. In essence, oil piston 33 is a safety valve which is sealed by O-rings, both to bearing shaft 23 and top sub 13*a*. Bearing shaft 23 has a small slot (not shown) that runs axially in the region where oil piston 33 seals to bearing shaft 23. As the oil expands, the slot will push oil piston 33 upward (FIG. 1*a*). The excess oil can escape through the slot into chamber 15. Once the pressure has been relieved, spring 39 will return oil piston 33 to its starting position. The seals on oil piston 33 move over the top of the slot, thereby blocking the release of additional oil. Annulus 37 should not be filled with oil. Top sub 13*a* contains a passage 45 which may be used for filling tool 11 with oil or bleeding air from tool 11.

An oscillator shaft 51 is rigidly coupled and sealed to the lower end of bearing shaft 23 for rotation therewith. Oscillator shaft 51 extends downward through a central bore in the third segment of housing 13, oscillator housing 13*c*. The seals on oil piston 33 prevent the bore of oscillator housing 13*c* from communicating with annulus 37 through a passage 53 in bearing housing 13*b*. In addition, oscillator shaft 51 contains an axial passage 51*a* which is in fluid communication with passage 24 in bearing shaft 23.

Referring to FIG. 1B, oscillator shaft 51 has a plurality of integral, external cams 55. Cams 55 are evenly spaced-apart, parallel to one another, and have a generally cylindrical shape which is skewed radially relative to oscillator shaft 51. Each cam 55 has upper and lower surfaces that are perpendicular to oscillator housing 13*c*. The skewing of cams 55 results in each cam 55 having a high side 55*a* and a low side 55*b*. The high sides 55*a* are 180 degrees out of phase with the low sides 55*b*. The high side 55*a* and low side 55*b* of each cam 55 are axially aligned with those of the other cams 55 so that all of the cams 55 are in phase with one another. Each cam 55 also has an outer edge which is parallel to oscillator housing 13*c* and represents a thickness of cam 55.

A tubular carrier cage 61 surrounds oscillator shaft 51 inside of oscillator housing 13*c*. Carrier cage 61 is free to move axially relative to oscillator housing 13*c* but is preventing from rotating by splines (not shown) on a guide adapter 75 (FIG. 1C). The inner diameter of carrier cage 61 is slightly larger than the outer diameter of cams 55 so that carrier cage 61 closely receives cams 55 but allows movement therebetween. Carrier cage 61 has a plurality of evenly spaced-apart radial holes 63. Holes 63 are aligned axially along the length of carrier cage 61. In the embodiment shown, carrier cage 61 has four sets of nine holes 63, wherein each set is axially parallel and circumferentially offset by increments of 90 degrees relative to the other sets.

Each hole 63 in one of the sets of holes 63 contains a cylindrical drive pin 65 which is perpendicular to carrier cage 61. The three unused sets of holes 63 are provided as alternate sites for drive pins 63. Each drive pin 65 has a radially outer portion 65*a* which is mounted in a hole 63, and a radially inner portion 65*b* which inserts between two cams 55. Outer portions 65*a* are larger in diameter than inner portions 65*b*. Each inner portion 65*b* is surrounded by a tubular drive pin bushing 67. Inner portions 65*b* are approximately equal in length to drive pin bushings 67. Each pair of adjacent inner portions 65*b* are separated only by the thicknesses of cams 55. Drive pin bushings 67 have an outer diameter which is slightly less than the distance between each pair of cams 55. The close tolerances between oscillator shaft 51, cams 55, carrier cage 61, drive pins 63 and drive pin bushings 67 restrict the radial motion of drive pins 63 while allowing cams 55 to rotate with drive pin bushings 67 between them.

As shown in FIG. 1C, a tubular inner mandrel 71 is rigidly coupled and sealed to a lower end of oscillator shaft 51 for rotation therewith. Inner mandrel 71 extends downward through central bores in the fourth and fifth segments of housing 13, isolation adapter 13*d* and piston housing 13*e*, respectively. The lower end of inner mandrel 71 is slidingly received in the lower portion of the bore of piston housing 13*e* (FIG. 1D). The bores of isolation adapter 13*d* and oscillator housing 13*c* are in fluid communication with one another and filled with oil, but communication with piston housing 13*e* is stopped by seals or O-rings 85 (FIG. 1C). From seals 85 and up, the moving parts, such as oscillator shaft 51 and pin carrier 61, are in an oil bath. Below seals 85, the passages are filled with drilling mud. In addition, inner mandrel 71 contains a central passage 71*a* which is in fluid communication with passage 51*a* in oscillator shaft 51.

A generally cylindrical oscillator guide adapter 75 is rigidly fastened to the lower end of and coaxial with carrier cage 61 for axial movement therewith. Guide adapter 75 engages splines (not shown) on isolation adapter 13*d*. Guide adapter 75 has an internal flange 79 with an inner diameter which is larger than an outer diameter of inner mandrel 71.

A cylindrical piston mandrel 81 is rigidly fastened to the lower end of and coaxial with guide adapter 75 for axial movement therewith. The upper portion 83 of the outer surface of piston mandrel 81 is slightly smaller than and slidingly engages and seals against O-ring seal 85 in the bore of isolation adapter 13*d*. Piston mandrel 81 also has an external radial piston 87 with an outer diameter which is closely received by the bore at the upper end of piston housing 13*e*. Piston 87 is located near the medial portion of piston mandrel 81. A plurality of coaxial, elastomeric annular seals 88 are mounted to piston 87. Piston 87 moves axially within a chamber 89 formed between piston mandrel 81 and piston housing 13*e*. The lower portion 91 of piston mandrel 81 slidingly engages and seals against a seal 93 of the bore of piston housing 13*e*. Thus, chamber 89 is sealed on its upper end by upper portion 83 and seal 85, and on its lower end by lower portion 91 and seal 93.

Piston housing 13*e* contains a series of longitudinal passages 101, 103 which are parallel to and in fluid communication with chamber 89. Passages 101 and 103 are circumferentially spaced apart by 180 degrees and communicate with the upper and lower ends, respectively, of chamber 89. Passages 105 and 107 (FIGS. 3 and 5) are also circumferentially spaced apart by 180 degrees and communicate with the upper and lower ends, respectively, of chamber 89. Passages 101, 103 are circumferentially spaced apart by 90 degrees relative to passages 105, 107. Intake valves 109*a*, 109*b* (FIG. 1D) are located at the lower end of each passage 101, 103, respectively. In the embodiment shown, valves 109*a*, 109*b* are check valves which allow fluid to flow in an upward direction into passages 101, 103, respectively, but prevent downward flow. Discharge valves 110*a*, 110*b* (FIG. 3) are located at the lower end of each passage 105, 107, respectively. In the embodiment shown, valves 110*a*, 110*b* are check valves which allow fluid to flow in a downward direction, but prevent upward flow.

Referring now to FIG. 1D, a bit sub 13*g* is rigidly secured and sealed to the lower end of piston housing 13*e* by a lower housing connector 13*f*. Bit sub 13*g* and piston housing 13*e* are axially separated from contact by a small chamber 111. An isolation tube 113 with a solid outer wall sealingly extends across chamber 111 between a lower bore 115 in piston housing 13*e* and a coaxial bore 117 in bit sub 13*g*. Piston housing 13*e* has an internal flange 119 which separates its medial portion 93 from lower bore 115.

A top screen mount 121 is mounted in the upper end of lower bore 115 and abuts the lower side of flange 119. A tubular screen 123 is mounted between top screen mount 121 and isolation tube 113. Screen 123 has a plurality of small slots which communicate with its axial interior. Screen 123 is self-cleaning and allows drilling mud to flow radially through its slots while preventing the passage of larger solid objects to valves 109, 110 which are also self-cleaning. Screen 123 is coaxial with bore 71*a*, top screen mount 121, isolation tube 113 and bore 117. Screen 123 is located within an axial chamber 125 in lower bore 115. Short transverse passages 127*a*, 127*b* extend radially outward from chamber 125 to intake valves 109*a*, 109*b*, respectively. Discharge valves 110*a*, 110*b* (FIG. 3) selectively communicate fluid in a downward direction from passages 105, 107, respectively, to chamber 111.

Referring back to FIG. 1D, bit sub 13*g* contains a longitudinal passage 131 which is inclined slightly relative to bore 117. Passage 131 is provided for communicating fluid between chamber 111 and a large opening 133 at the lower end of bit sub 13*g*. In the preferred embodiment, passage 131 is connected to a dedicated nozzle in the drill bit (not shown). Bore 117 is also in fluid communication with opening 133. Bit sub 13*g* contains a longitudinal damper cylinder 141 which is parallel to bore 117 and communicates with chamber 111. Damper cylinder 141 contains a selectively actuated cap 143 at an upper end. Cap 143 is rigidly attached to bit sub 13*g*. Beneath cap 143 is a piston with a radial seal (not shown). A chamber is located below the piston and is filled with a compressible fluid. Cap 143 has a hole for communicating drilling mud pressure to the piston. A seal on the piston separates the drilling mud from the compressible fluid reservoir.

In operation, top sub 13*a* of tool 11 is secured to the lower end of drill string 12. A drill bit (not shown) is attached to bit sub 13*g* at the lower end of tool 11. During drilling operations, the mud motor 24 is rotated by the downward flow of mud through drill string 12 at approximately 150–200 rpm. Mud motor 24 rotates spline collar 21 (FIG. 1A) as mud flows through the central coaxial bores and passages of tool 11. Any kicks or thrusts experienced by mud motor 24 will be absorbed by thrust bearings 25, 27.

Bearing shaft 23 and oscillator shaft 51 rotate in unison with spline collar 21. As oscillator shaft 51 rotates, the upper and lower surfaces of cams 55 (FIG. 1B) engage drive pins 65 through drive pin bushings 67. The drive pins 65 ride between the high sides 55*a* and low sides 55*b* of cams 55 in a reciprocating, two inch axial displacement or path. Drive pins 65 reverse direction for every 180 degrees of rotation of oscillator shaft 51 and cams 55. Drive pins 65 cause carrier cage 61 to oscillate with them which in turn reciprocates guide adapter 75, piston mandrel 81 and piston 87 (FIG. 1C) around rotating inner mandrel 71. Drilling mud flows axially downward from the upper portion of tool 11 through passage 71*a,* screen 123, top screen mount 121, isolation tube 113, bore 117 and opening 133 to the drill bit.

Figure 2:
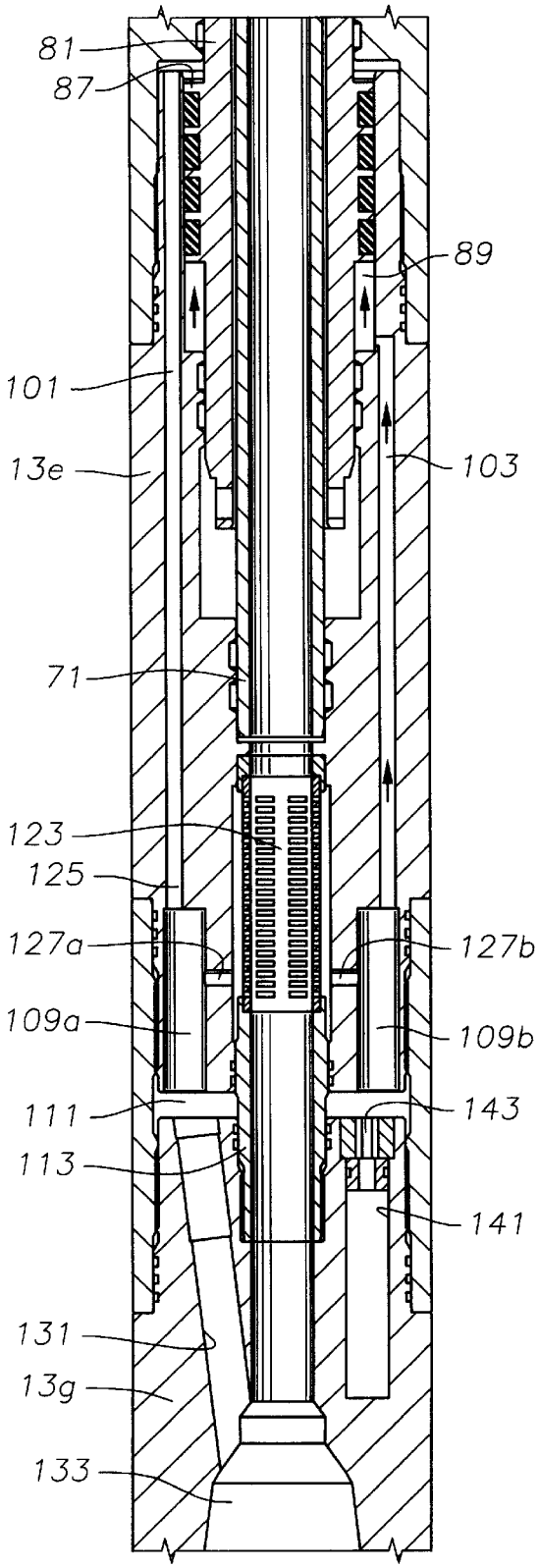
FIG. 2 is a sectional side view of a lower portion of the intensifier of FIG. 1A with a piston in the upstroke position.
Figure 3:
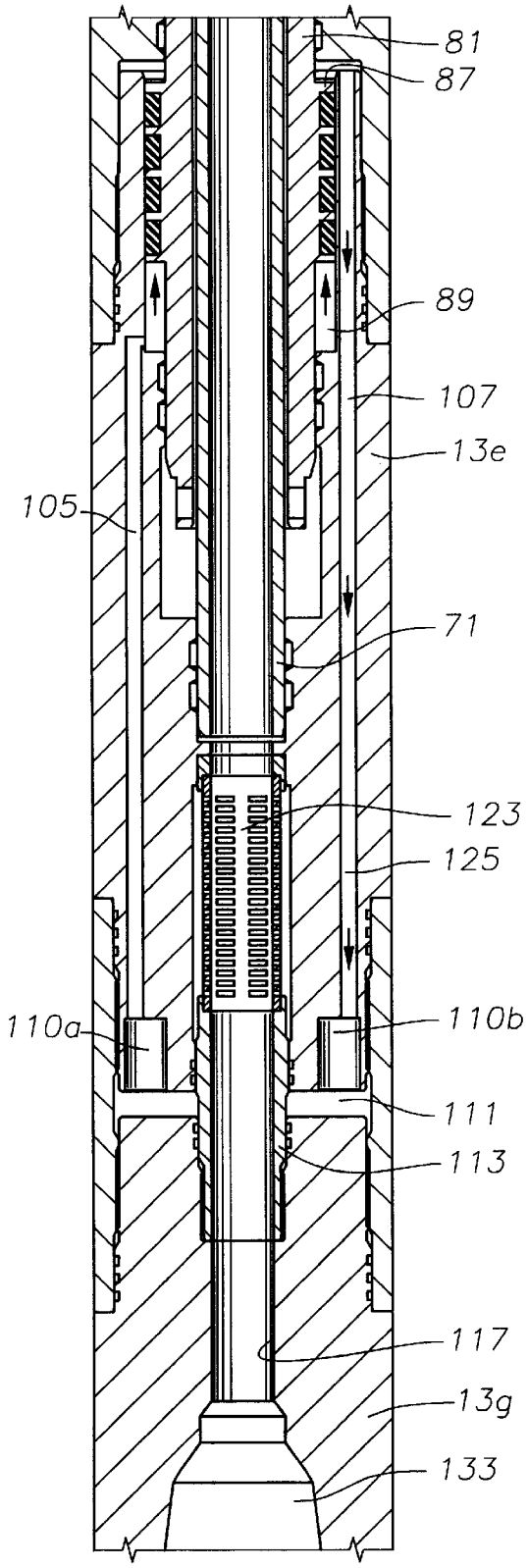
FIG. 3 is a transverse sectional side view of the intensifier of FIG. 2 with the piston in the upstroke position.

As shown in FIGS. 2 and 3, piston mandrel 81 and piston 87 have an upstroke position wherein a small portion (approximately five percent) of the mud flowing axially through screen 123 is drawn radially outward through screen 123 into chamber 125, passage 127*b,* intake valve 109*b* and passage 103 into a lower portion of chamber 89. Referring to FIG. 3, piston 87 simultaneously expels mud which was in the upper portion of chamber 89 through passage 107, discharge valve 110*b,* chamber 111, passage 131 (FIG. 2) and opening 133 to the drill bit. The pressure of the mud circulated through chamber 89 is intensified or increased to facilitate greater drill bit penetration as it is directed through a hose which is sealed and secured in passage 131 to the drill bit. The intensified mud does not rejoin the low pressure mud until both have exited the drill bit. Damper cylinder assembly 141 serves as a shock absorber to even out pressure spikes created by the piston strokes to produce a more even flow.

Figure 4:
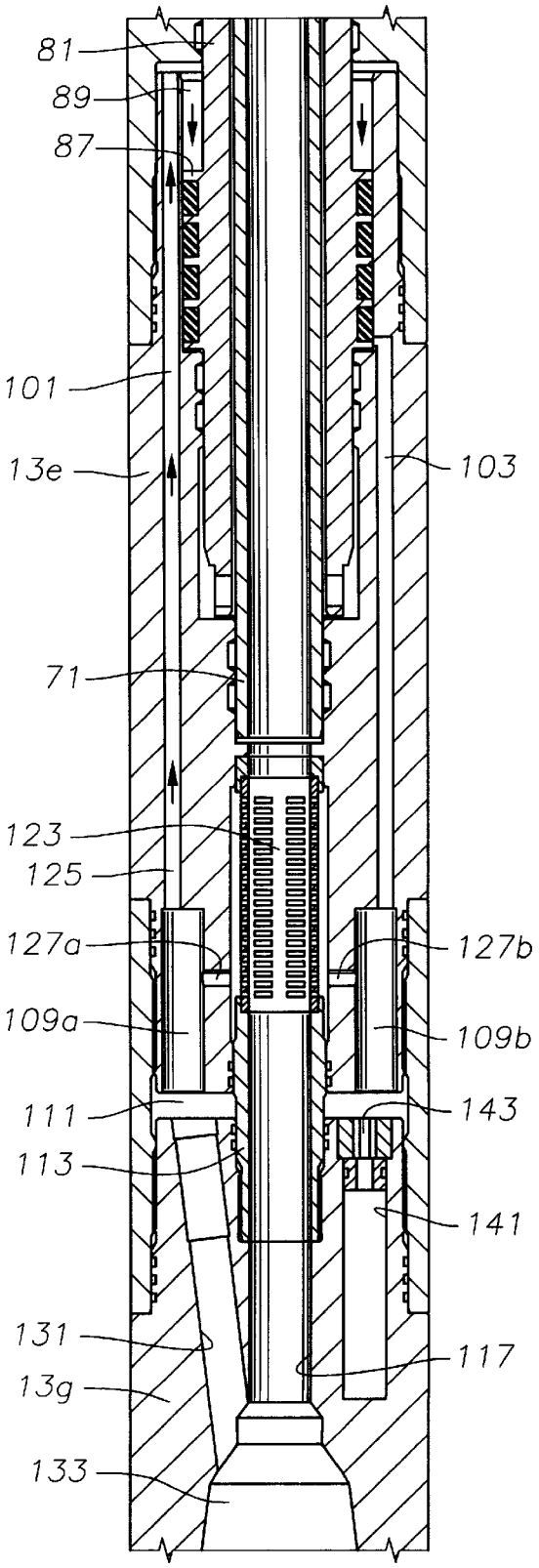
FIG. 4 is a sectional side view of the intensifier of FIG. 2 with the piston in the downstroke position.
Figure 5:
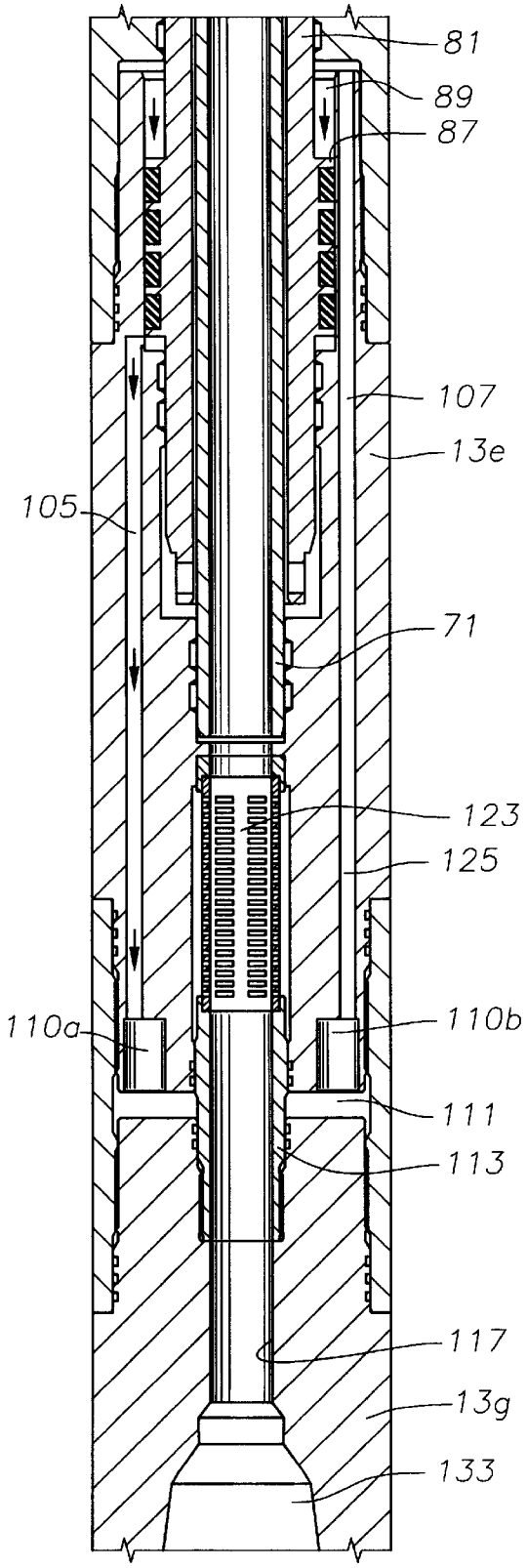
FIG. 5 is a transverse sectional side view of the intensifier of FIG. 2 with the piston in the downstroke position.

As shown in FIGS. 4 and 5, piston mandrel 81 and piston 87 also have a downstroke position wherein a small portion of the axially flowing mud is similarly intensified. As piston 87 moves to the downstroke position, mud is drawn radially outward into chamber 125, passage 127*a,* intake valve 109*a* and passage 101 into an upper portion of chamber 89. Referring to FIG. piston 87 simultaneously expels mud which was in the lower portion of chamber 89 through passage 105, discharge valve 110*a,* chamber 111, and passage 131 (FIG. 4) which is connected to a dedicated nozzle in the drill bit. The pressure of the mud circulated through chamber 89 is intensified and discharged through the drill bit. As described previously, damper cylinder 141 absorbs shock created by the piston to produce a more even flow. Thus, tool 11 continuously generates a steady supply of intensified drilling mud to the drill bit, both on the upstroke and on the downstroke.

The invention has several advantages. The intensifier tool balances the desire to increase the pressure of the drilling mud with the need to promote the longevity of the tool by intensifying only a small portion of the flowing mud while maintaining excellent penetration rates. The tool is self-contained and need only be inserted between a conventional drill bit and the rest of the drill string without requiring any special equipment or drilling fluids. Drilling proceeds with normal parameters such as circulation rate and pressure, rotational speed and weight on the bit. The tool is self-cleaning and the condition of the drilling fluid is maintained as would be normal without the tool. Finally, if the tool should ever fail, the system will revert to conventional drilling and the tool will merely act as a piece of pipe. Thus, the tool is fail safe so that drilling can continue without having to pull the tool out of the hole.

While the invention has been shown or described in only some of its forms, it should be apparent to those skilled in the art that it is not so limited, but is susceptible to various changes without departing from the scope of the invention.

I claim:

1. A mud pressure intensifier for connection into a drill string having a drill bit on a lower end and a mud motor with a rotary output shaft, the intensifier comprising:

a housing;

a flow passage located within the housing for delivering mud from the mud motor to the drill bit;

a conversion mechanism located within the housing and adapted to be mounted to the output shaft of the mud motor for converting rotary motion of the output shaft into axial reciprocating motion;

a chamber located within the housing;

a piston having an upstroke and a downstroke for applying pressure to and drawing fluid into the chamber, the piston being connected to and operable in response to the axial reciprocating motion of the conversion mechanism;

an intake passage leading from the flow passage to the chamber;

a discharge passage leading from the chamber to the drill bit; wherein the piston draws a portion of the drilling mud from the flow passage, through the intake passage and into the chamber on one of the strokes, and expels drilling mud from the chamber, through the discharge passage and out the drill bit on the other of the strokes at a pressure which is in excess of a pressure of the drilling mud flowing from the mud motor into the flow passage.

2. The intensifier of claim 1 wherein the conversion mechanism comprises:

a first member which is rotatable in response to the mud motor; and a second member which engages the first member and is axially reciprocated in response to rotation of the first member.

3. The intensifier of claim 1 wherein the conversion mechanism comprises:

a cam drive member which is rotatable in response to the mud motor; and an oscillator member which engages the cam drive member and is axially reciprocated in response to rotation of the cam drive member; and wherein the piston is connected to the oscillator member for axial movement therewith.

4. The intensifier of claim 1 wherein the conversion mechanism comprises:

an oscillator shaft which is rotatable in response to the mud motor;

a cam member extending from the oscillator shaft for rotation therewith;

an oscillator sleeve surrounding and coaxial with the oscillator shaft, the oscillator sleeve being limited to axial movement relative to the housing; and a drive member mounted in the oscillator sleeve for engaging the cam member and causing the oscillator sleeve to reciprocate axially in response to rotation of the oscillator shaft.

5. The intensifier of claim 4 wherein the cam member is a disk which is coaxially mounted to the oscillator shaft, the disk being skewed relative to the oscillator shaft.

6. The intensifier of claim 1 wherein the flow passage is coaxial with and extends throughout a length of the housing.

7. The intensifier of claim 1 wherein the flow passage extends unobstructed throughout the housing along a longitudinal axis.

8. The intensifier of claim 1 wherein the chamber and the piston are located below the conversion mechanism.

9. The intensifier of claim 1, further comprising a dampening device located within the housing for absorbing pressure spikes generated by the intensifier.

10. The intensifier of claim 1, further comprising a first check valve in the intake passage which allows fluid to flow from the flow passage to the chamber, but prevents flow back into the flow passage; and a second check valve in the discharge passage which allows fluid to flow from the chamber to the drill bit, but prevents flow back into the chamber.

11. The intensifier of claim 1, further comprising a screen located between the flow passage and the intake passage for screening the drilling mud drawn into the chamber.

12. In a drill string having a housing with a longitudinal axis and a drill bit on a lower end, the housing containing an improved mud pressure intensifier and a mud motor with a rotary output shaft, the improvement comprising:

a flow passage extending unobstructed throughout the housing along the longitudinal axis for delivering mud from the mud motor to the drill bit;

a conversion mechanism mounted to the output shaft of the mud motor for converting rotary motion of the output shaft into axial reciprocating motion;

a cylinder located within the housing;

a piston located within the cylinder and having an upstroke and a downstroke for drawing fluid into and expelling fluid from the cylinder, the piston being connected to and operable in response to the axial reciprocating motion of the conversion mechanism;

an upstroke intake passage leading from the flow passage to a lower end of the cylinder;

an upstroke discharge passage leading from an upper end of the cylinder to the drill bit;

a downstroke intake passage leading from the flow passage to an upper end of the cylinder;

a downstroke discharge passage leading from a lower end of the cylinder to the drill bit; wherein the piston draws a portion of the drilling mud from the flow passage, through the upstroke intake passage and into the lower end of the cylinder, and expels drilling mud from the upper end of the cylinder, through the upstroke discharge passage and out the drill bit on the upstroke; and wherein the piston draws a portion of the drilling mud from the flow passage, through the downstroke intake passage and into the upper end of the cylinder, and expels drilling mud from the lower end of the cylinder, through the downstroke discharge passage and out the drill bit on the downstroke at a pressure which is in excess of a pressure of the drilling mud flowing from the mud motor into the flow passage.

13. The intensifier of claim 12 wherein the conversion mechanism comprises:

a first member which is rotatable in response to the mud motor; and a second member which engages the first member and is axially reciprocated in response to rotation of the first member.

14. The intensifier of claim 12 wherein the conversion mechanism comprises:

an oscillator shaft which is rotatable in response to the mud motor;

a cam disk coaxially mounted to the oscillator shaft for rotation therewith, the disk being skewed relative to the oscillator shaft;

an oscillator sleeve surrounding and coaxial with the oscillator shaft, the oscillator sleeve being limited to axial movement relative to the housing; and a drive member mounted in the oscillator sleeve for engaging the cam disk and causing the oscillator sleeve to reciprocate axially in response to rotation of the oscillator shaft.

15. The intensifier of claim 12, further comprising a damper piston and chamber located within the housing for absorbing pressure spikes generated by the intensifier.

16. The intensifier of claim 12, further comprising a first check valve in each of the intake passages which allow fluid to flow from the flow passage to the cylinder, but prevent flow back into the flow passage; and a second check valve in each of the discharge passages which allow fluid to flow from the cylinder to the drill bit, but prevent flow back into the cylinder.

17. The intensifier of claim 12, further comprising a screen located between the flow passage and the intake passages for screening the drilling mud drawn into the cylinder.

18. An apparatus for increasing the pressure of drilling mud in a drill string having a longitudinal axis and a drill bit on a lower end, comprising:

a drilling mud motor with a rotary output shaft;

a housing;

a flow passage extending axially through the housing for delivering mud from the mud motor to the drill bit;

a cam drive member mounted to the output shaft of the mud motor for converting rotary motion of the output shaft into axial reciprocating motion;

an oscillator member which engages the cam drive member and is axially reciprocated in response to rotation of the cam drive member;

a cylinder located within the housing;

a piston located within the cylinder and mounted to the oscillator member for axial movement therewith, the piston having an upstroke and a downstroke for drawing fluid into and expelling fluid from the cylinder, the piston being connected to and operable in response to the axial reciprocating motion of the cam drive member;

an upstroke intake passage leading from the flow passage to a lower end of the cylinder;

an upstroke discharge passage leading from an upper end of the cylinder to the drill bit;

a downstroke intake passage leading from the flow passage to an upper end of the cylinder;

a downstroke discharge passage leading from a lower end of the cylinder to the drill bit;

a first check valve in each of the intake passages which allow fluid to flow from the flow passage to the cylinder, but prevent flow back into the flow passage;

a second check valve in each of the discharge passages which allow fluid to flow from the cylinder to the drill bit, but prevent flow back into the cylinder; wherein the piston draws a portion of the drilling mud from the flow passage, through the upstroke intake passage and into the lower end of the cylinder, and expels drilling mud from the upper end of the cylinder, through the upstroke discharge passage and out the drill bit on the upstroke; and wherein the piston draws a portion of the drilling mud from the flow passage, through the downstroke intake passage and into the upper end of the cylinder, and expels drilling mud from the lower end of the cylinder, through the downstroke discharge passage and out the drill bit on the downstroke at a pressure which is in excess of a pressure of the drilling mud flowing from the mud motor into the flow passage.

19. The intensifier of claim 18 wherein the oscillator member comprises:

an oscillator shaft which is rotatable in response to the mud motor;

a cam disk coaxially mounted to the oscillator shaft for rotation therewith, the disk being skewed relative to the oscillator shaft; and wherein the oscillator member comprises:

an oscillator sleeve surrounding and coaxial with the oscillator shaft, the oscillator sleeve being limited to axial movement relative to the housing; and a drive member mounted in the oscillator sleeve for engaging the cam disk and causing the oscillator sleeve to reciprocate axially in response to rotation of the oscillator shaft.

20. The intensifier of claim 18, further comprising a damper piston and chamber located within the housing for absorbing pressure spikes generated by the intensifier.

21. The intensifier of claim 18, further comprising a screen located between the flow passage and the intake passages for screening the drilling mud drawn into the cylinder.

22. A method for intensifying the pressure of drilling mud in a drill string having a housing with a longitudinal axis, a drill bit on a lower end and a rotary mud motor, comprising:

(a) circulating drilling mud from the mud motor through a flow passage in the housing to the drill bit;

(b) converting rotary motion of the mud motor into axial reciprocating motion of a piston, the piston being located within a chamber in the housing and having an upstroke and a downstroke for applying pressure to and drawing fluid into the chamber;

(c) drawing a portion of the drilling mud from the flow passage, through an intake passage and into the chamber on one of the strokes; and then (d) expelling drilling mud from the chamber, through a discharge passage and out the drill bit on the other of the strokes at a pressure which is in excess of a pressure of the drilling mud flowing from the mud motor into the flow passage.

23. The method of claim 22 wherein step (c) comprises:

drawing a portion of the drilling mud from the flow passage into a lower end of the chamber; and further comprises simultaneously expelling drilling mud from an upper end of the chamber to the drill bit on the upstroke; and wherein step (d) comprises expelling drilling mud from the lower end of the chamber to the drill bit on the downstroke; and further comprises simultaneously drawing a portion of the drilling mud from the flow passage into the upper end of the chamber.

24. The method of claim 22, further comprising the step of reducing pressure spikes generated by the strokes of the piston.

* * * * *